US011557171B2

(12) United States Patent
Harmon

(10) Patent No.: US 11,557,171 B2
(45) Date of Patent: Jan. 17, 2023

(54) SYSTEM, METHOD, AND NON-TRANSITORY COMPUTER READABLE MEDIUM FOR PEER-TO-PEER WAGERING

(71) Applicant: Kutt, Inc., Gilbert, SC (US)

(72) Inventor: Simeon Harmon, Gilbert, SC (US)

(73) Assignee: Kutt, Inc., Gilbert, SC (US)

( * ) Notice: Subject to any disclaimer, the term of this patent is extended or adjusted under 35 U.S.C. 154(b) by 14 days.

(21) Appl. No.: 17/365,637

(22) Filed: Jul. 1, 2021

(65) Prior Publication Data

US 2022/0005314 A1 Jan. 6, 2022

Related U.S. Application Data

(60) Provisional application No. 63/047,618, filed on Jul. 2, 2020.

(51) Int. Cl.
*G07F 17/32* (2006.01)
*G06Q 50/34* (2012.01)

(52) U.S. Cl.
CPC ..... *G07F 17/3225* (2013.01); *G06Q 50/34* (2013.01); *G07F 17/3244* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 10,515,516 | B1 | 12/2019 | Eckman et al. | |
| 10,937,279 | B1 * | 3/2021 | Workman | G07F 17/3239 |
| 10,970,909 | B2 * | 4/2021 | Lu | G06T 13/205 |
| 11,200,779 | B2 * | 12/2021 | Marantelli | G07F 17/34 |
| 11,328,556 | B2 * | 5/2022 | Marantelli | A63F 13/00 |
| 2019/0236892 | A1 * | 8/2019 | English | G07F 17/3288 |
| 2019/0362601 | A1 * | 11/2019 | Kline | G07F 17/3288 |
| 2021/0074127 | A1 * | 3/2021 | Fleck | G07F 17/3269 |

* cited by examiner

*Primary Examiner* — Ronald Laneau
(74) *Attorney, Agent, or Firm* — Howard & Howard Attorneys PLLC

(57) ABSTRACT

A system, method, and non-transitory computer readable medium for peer-to-peer wagering includes selecting a wagering game and wager on the game, present a list of identified users, enable the user to select one, transmit terms of the wager, receive payment from the user, determine if the selected identified user agreed to terms of the wager or made a counterwager, transmit the terms of the wager to a third identified party if the selected identified user does not agree, determine if the third identified party agreed to the terms of the wager or made a counterwager, receive payment from the selected identified user or the third identified party, link an agreed wagering activity of the user and either the selected identified user or the third identified party, automatically place the wager on the game, and settle payment of the wager after the game occurs.

21 Claims, 14 Drawing Sheets

500

500

500

500

500

500

SYSTEM, METHOD, AND NON-TRANSITORY COMPUTER READABLE MEDIUM FOR PEER-TO-PEER WAGERING

CROSS-REFERENCE TO RELATED APPLICATION(S)

The present application claims the benefit of and priority to U.S. Provisional Patent Application Ser. No. 63/047,618, filed Jul. 2, 2020, the entire disclosure of which is hereby expressly incorporated by reference.

BACKGROUND OF THE INVENTION

Field of the Invention

The present disclosure relates generally to peer-to-peer wagering and, more specifically, to a system, method, and non-transitory computer readable medium for peer-to-peer wagering.

Description of Related Art

Wagering such as sports wagering is very popular with bettors and provides a significant source of revenue for bookmakers. Traditionally, wagers are placed on sports games in a race and sports book within a casino, for example. A player fills out a card with the desired wager amount and the outcome the player wishes to wager on. However, having to physically travel to a location that legally offers sports betting may be inconvenient and costly. As a result, some prospective bettors who would like to bet on sports games may be prevented or discouraged from doing so. This leads to a loss in gaming revenue for race and sports books, casinos, and other gaming establishments. Since people who bet on sports games are more likely to watch the games, this may also lead to a loss of advertising and other revenue for sports franchises and media distribution companies.

One of the problems with existing ways to bet on sports is that there are excessive fees to place a bet. Another problem is that the existing ways are difficult to access and lines are unable to be negotiated. A further problem is that there is counterparty risk and/or inability to bet with strangers. Still another problem is that there are limits on how much a person can bet if they become a successful sports better.

It is known to provide a peer-to-peer wagering system. For example, U.S. Pat. No. 10,515,516 to Eckman et al. discloses a peer-to-peer competition wagering exchange network method and system. The system can include receiving schedule data associated with a competition or game-based event, receiving a selection from a first user to participate in the competition or event, receiving a selection from the first user for a competitor associated with the competition, and receiving a wagered, placed, or contributed monetary amount or token of value with respect to the selected competitor from the first user. The system can further include receiving a point spread or line with respect to the competition from the first user, and generating a challenge, contest, or campaign based on the received selected competitor, received wagered amount, and received point or spread by the first user. The system may automatically direct funds into various trust accounts associated with one or more entities, and further direct those trust accounts or entities to transfer funds into a user's financial institution, bank account, credit account, digital currency settlement account, currency exchange account, digital currency ledger, among others, or alternatively issue cash, check, tokens, coupons, promotions, credits, and incentives, among others. However, the system does not provide access to real time online betting and event information including betting lines, spreads, over/unders as well as current scores and final end result scores of games with the combination of features of a mobile payment request that has to be accepted and a sortable leaderboard with statistics.

The present disclosure is aimed at solving one or more of the problems identified above.

SUMMARY OF THE INVENTION

The present invention provides a system for peer-to-peer wagering including a database configured to store data associated with a plurality of users, the associated data including statistics related to prior wagers made by each user, a computing system configured to communicate with the database, and an application executable by a processor of a user computing device and to communicate with the computing system. The application is configured to have the processor execute an algorithm with instructions to enable the user to make a wager by selecting a wagering game and wager on the wagering game, present a list of identified users to a user using the application on the user computing device, enable the user to select one of the identified users from the list of identified users, and transmit terms of the wager to the selected identified user to the computing system. The computing system is configured to receive payment from the user for the wager on the wagering game, determine if the selected identified user agreed to terms of the wager or made a counterwager, transmit the wager to the computing system for a third identified party of users if the selected identified user does not agree, determine if the third identified party agreed to the terms of the wager or made a counterwager, receive payment from the selected identified user or the third identified party that has to be accepted before the game occurs, link an agreed wagering activity of the user and either the selected identified user or the third identified party to allow the agreed wager to be placed, automatically place the wager on the wagering game according to the agreed wagering activity, and settle payment of the wager after the wagering game occurs between the user and the selected identified user or third identified party.

The present invention also provides a method for peer-to-peer wagering including the steps of storing, in a database, data associated with a plurality of users, the associated data including statistics related to prior wagers made by each user, establishing by a computing system communication with the database, and executing an application by a processor of a user computing device and communicating with the user computing device, wherein the application is configured to have the processor execute an algorithm with instructions enabling, by the application, the user to make a wager by selecting a wagering game and wager on the wagering game, presenting, by the application, a list of identified users to a user, enabling, by the application, the user to select one of the identified users from the list of identified users, and transmitting, by the application, the terms of the wager to the selected identified user to the computing system, receiving payment, by the computing system, from the user for the wager on the wagering game, determine if the selected identified user agreed to terms of the wager or made a counterwager, transmitting, by the application, the wager to the computing system for a third identified party of the users if the selected identified user does not agree, determining, by the application, if the third party agreed to the terms of the wager or made a counter-wager, receiving payment, by the computing system, from the selected identified user or the third identified party that has to be accepted before the wagering game occurs, linking, by the computing system, an agreed wagering activity of the user and either the selected identified user or the third identified party to allow the agreed wager to be placed, automatically place, by the computing system, the wager on the wagering game according to the agreed wagering activity, and settling payment of the wager, by the computing system, after the wagering game occurs directly between the user and the selected identified user or third identified party.

The present invention further provides a non-transitory computer readable medium having computer-executable instructions for execution by one or more computing devices for peer-to-peer wagering. The computer-executable instructions include steps to enable the user to make a wager by selecting a wagering game and wager on the wagering game, present a list of identified users to a user, enable the user to select one of the identified users from the list of identified users, and transmit terms of the wager to the selected identified user, wherein the receive payment from the user for the wager on the wagering game, determine if the selected identified user agreed to the terms of the wager or made a counterwager, transmit the terms of the wager for a third identified party of the users if the selected identified user does not agree, determine if the third identified party agreed to the terms of the wager or made a counterwager, receive payment from the selected identified user or the third identified party that has to be accepted before the wagering game occurs, link an agreed wagering activity of the user and either the selected identified user or the third identified party to allow the agreed wager to be placed, automatically place the wager on the wagering game according to the agreed wagering activity, and settle payment of the wager after the wagering game occurs directly between the user and the selected identified user or the third identified party.

One advantage of the present invention is that the system, method, and non-transitory computer readable medium provides a peer-to-peer wagering or betting platform to support betting on sporting games and events between two individuals. Another advantage of the present invention is that the system, method, and non-transitory computer readable medium allows friends and acquaintances to seamlessly bet with each other on any sporting event. Yet another advantage of the present invention is that the system, method, and non-transitory computer readable medium provide the ability to negotiate lines with counterparties. Still another advantage of the present invention is that the system, method, and non-transitory computer readable medium allows a counterparty (they are not anonymous) to be known, real money to be bet via mobile payment request that has to be accepted before the game occurs and automated payout upon the conclusion of the game, negotiation of the lines and payouts with a counterparty (ability to create user betting lines), ability to counter a bet with user variables, sortable leaderboard with statistics, messages to be sent to a counterparty, recordkeeping for past betting performance, and ability to create user groups of similar bettors. A further advantage of the present invention is that the system, method, and non-transitory computer readable medium provides for a user wagering against an identified counterparty and interacting/settling directly with them.

Other advantages and features of the present disclosure will be readily appreciated, as the same becomes better understood, by reference to the subsequent detailed description, when considered in connection with the accompanying drawings.

BRIEF DESCRIPTION OF THE DRAWINGS

Non-limiting and non-exhaustive embodiments of the present invention are described with reference to the following figures, wherein like numerals refer to like parts throughout the various views unless otherwise specified.

DETAILED DESCRIPTION OF THE PREFERRED EMBODIMENT(S)

Figure 1:
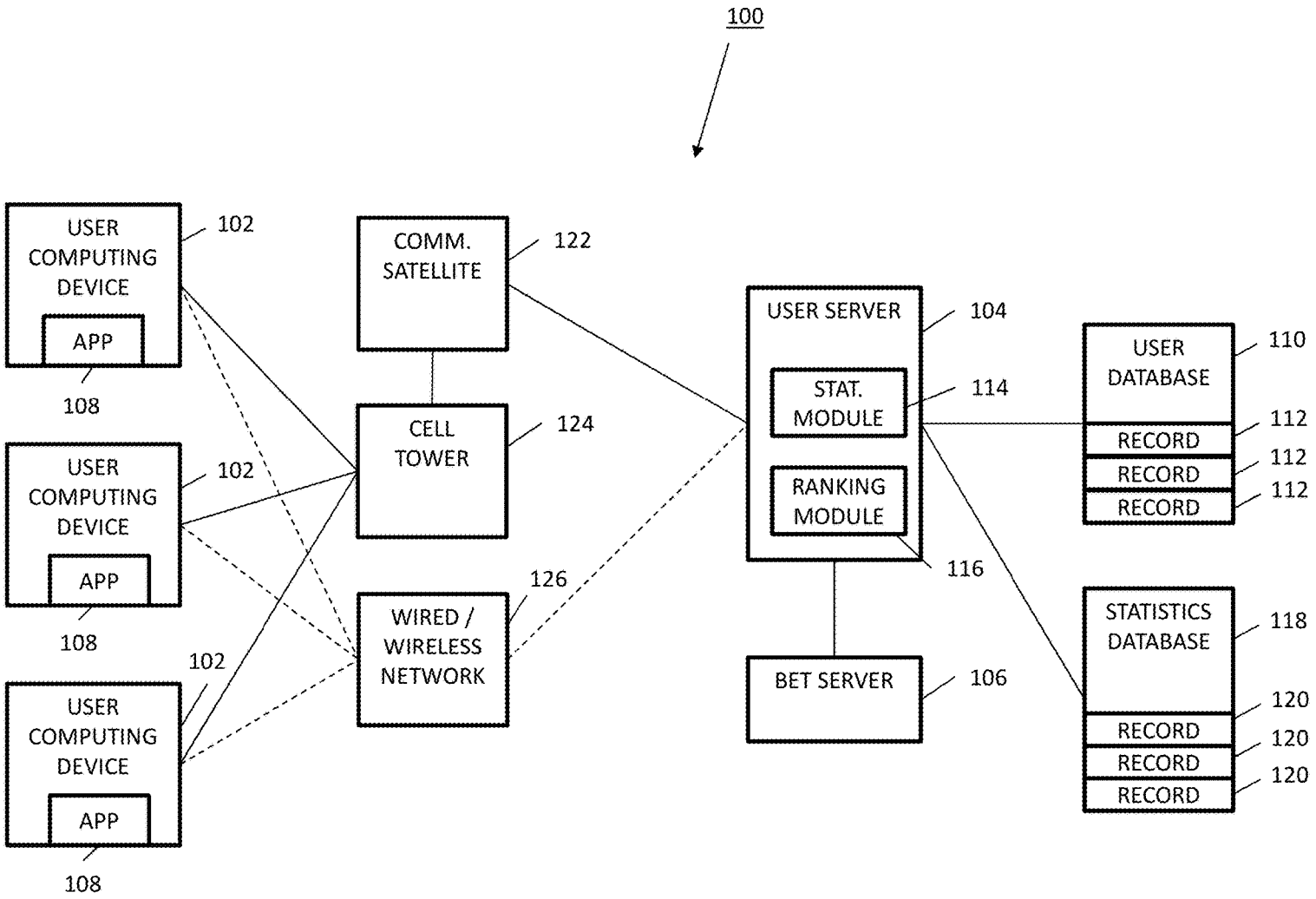
FIG. 1 is a block diagram illustrating an exemplary system for peer-to-peer wagering according to one embodiment of the present invention.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an examples" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present invention may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system". Furthermore, the present invention may take the form of a computer program product embodied in any tangible media or expression having computer-usable program code embodied in the media.

Any combination of one or more computer-usable or computer-readable media (or medium) may be utilized. For example, a computer-readable media may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

Embodiments may also be implemented in cloud computing environments. In this description and the following claims, "cloud computing" may be defined as a model for enabling ubiquitous, convenient, on-demand network access to a shared pool of configurable computing resources (e.g., networks, servers, storage, applications, and services) that can be rapidly provisional via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS"), and deployment models (e.g., private cloud, community cloud, public cloud, hybrid cloud, etc.).

The block diagram(s), flow diagram(s), and flowchart(s) illustrate the architecture, functionality, and operation of possible implementations of systems, methods, and computer program products according to various embodiments of the present invention. In this regard, each block in the flowchart, flow diagrams, or block diagrams may represent a module, segment, or portion of code, which comprises one or more executable instructions for implementing the specified logical function(s). It will also be noted that each block of the block diagrams, flow diagrams, and/or flowchart illustrations, and combinations of blocks in the block diagrams, flow diagrams, and/or flowchart illustrations, may be implemented by special purpose hardware-based systems that perform the specified functions or acts, or combinations of special purpose hardware-based systems that perform the specified functions or acts, or combinations of special purpose hardware and computer instructions. These computer program instructions may also be stored in a computer-readable media that can direct a computer or other programmable data processing apparatus to function in a particular manner, such that the instructions stored in the computer-readable media produce an article of manufacture including instruction means which implement the function/act specified in the flowchart, flow diagram, and/or block diagram block or blocks.

Several (or different) elements discussed below, and/or claimed, are described as being "coupled", "in communication with" or "configured to be in communication with". This terminology is intended to be non-limiting, and where appropriate, be interpreted to include without limitation, wired and wireless communication using any one or a plurality of suitable protocols, as well as communication methods that are constantly maintained, are made on a periodic basis, and/or made or initiated on an as needed basis.

The present disclosure particularly describes a system, method, and non-transitory computer readable medium for enabling users to engage in wagering in a convenient, efficient, and social manner. The present disclosure provides a system, method, and non-transitory computer readable medium for peer-to-peer wagering, more particularly, a peer-to-peer sports betting platform to support betting on sporting games and events between two individuals. The peer-to-peer sports betting platform includes a system and method that will provide access to real time online betting and event information including betting lines, spreads, over/unders as well as current scores and final end result scores of games and events. The peer-to-peer sports betting platform is available as an application that is delivered from a desktop or laptop browser, or on a mobile device such as a smart phone or tablet.

The system is designed to allow a user to locate events that they may wish to bet on, using a number of criteria, and then locate another user to invite to join the bet. The system allows public bet invitations to be entered into the system by a user with the intent to have such a bet be accepted by another user. Each user has a profile that contains details about user betting preferences, their favorite teams, favorite sports, city and region of residence or interest as well as whether they are professional sport fans or college sports fan. This profile allows users to locate possible betting partners based on common interests.

The system also keeps a record of the user betting history such as a scorecard and will provide the user with the opportunity to make viewable their scorecard. The scorecard will give other users the chance to view or rate the success of possible betting partners.

FIG. 1 is a block diagram of an exemplary system 100 that may be used for peer-to-peer wagering. As used herein, the term "wagering game" includes a contest or application in which a user or player is enabled to place a wager on the outcome of a game. In one embodiment, the system 100 enables a user or player to bet or wager on an outcome of a professional sports game (i.e., sports wagering game). In another embodiment, the system 100 may enable a player to place a wager on a poker game, a horse race, a blackjack game, or any other suitable wagering game. In yet another embodiment, the system 100 enables a user or player to bet or wager on an outcome of a wagering game such as politics, entertainment, and/or other events with a verifiable and definitive outcome (i.e. a presidential election between two candidates). As used herein, the term "wager" and "bet" are used synonymously, and may involve real money wagering, "free to play" wagering with credits having no monetary or intrinsic value, or any combination thereof.

In one embodiment, the system 100 includes one or more user computing devices 102, and a computing system including a user server 104, and a bet server 106 configured to communicate with a database 110 to be described. The various components of the system 100 may be connected together by one or more wired or wireless networks. Although three user computing devices 102 are illustrated in FIG. 1, the system 100 may include any suitable number of the user computing devices 102. Also, while the system 100 is illustrated with the above components, it should be appreciated that one or more components of the system 100 may be combined together or split apart while remaining within the scope of the disclosure.

The user computing device 102 is a computing device that may be operated by a user (sometimes referred to herein as a player) to place a wager on the wagering game. The user computing devices 102 may include a mobile phone, a personal digital assistant (PDA), a tablet computer, a wearable computing device, a laptop computer, a desktop computer, a kiosk, a point-of-sale terminal, a virtual reality device, an augmented reality device, or any other suitable computing device that enables the user computing device 102 to operate as described herein. In one embodiment, an application or "app" 108 is installed on each user computing device 102 to enable the user to wager on a wagering game. In another embodiment, some or all of the functionality of user computing device 102 and/or application 108 may be embodied in a cashier-operated register, point-of-sale terminal, or the like.

The user server 104 is a computing device that enables multiple user computing devices 102 to place wagers on wagering games. In one embodiment, the user server 104 stores user information for each user in a user database 110 and associates the user information with the user computing device 102 that each user uses to access the user server 104. The user information may be stored in a plurality of records 112 in the user database 110. The records 112 may include a user name, a user password, a birth date, a scanned image of an identification document such as a driver's license or passport, funds available to the user, payment information including an account number to a financial institution used by the user, and/or any other suitable information or record. It should be appreciated that the user server 104 may retrieve the records 112 from the user database 110 by querying the user database 110 during operation.

In one embodiment, the user server 104 includes a user statistics module 114 that tracks various statistics of each player and a ranking module 116 that ranks players and determines leaders for each wagering game. For example, the user statistics module 114 may track a number of times and the amounts the user has bet on a particular wagering game, a number of times a user has won a bet, a number of times a user has lost a bet, which wagering games the user has bet on or followed, and/or any other suitable statistic. The statistics of each user may be stored in a statistics database 118 as a plurality of records 120 and may be retrieved by querying statistics database 118. The records 120 and associated statistics may be transmitted to the ranking module 116 or to another suitable server or module to aggregate the statistics of all the users. In another embodiment, the ranking module 116 may query the statistics database 118 directly to receive the statistics of each user.

The ranking module 116 receives statistics of each user from the user statistics module 114. The ranking module 116 aggregates the statistics, for example, to determine the leaders of each game. In one embodiment, the users who have the highest win percentage for each wagering game are determined to be leaders of that game. For example, the ten players with the highest win percentage for National Football League (NFL) sports wagering games may be determined to be leaders of the NFL sports wagering game. It should be appreciated that other criteria may be used to determine the leaders of each wagering game.

The bet server 106 is a computing device coupled to the user server 104 that provides wagering services to users. In one embodiment, the bet server 106 receives data from the user server 104 and places wagers on behalf of users based on the data received. For example, a user may place a wager on a wagering game using the user computing device 102. The user server 104 receives the wager and transmits the data representative of the wager to the bet server 106. The bet server 106 then places the wager and transmits any win amount resulting from the wager to the user server 104. In another embodiment, the bet server 106 transmits a notification of a win resulting from the wager to the user server 104 and the user server 104 determines the win amount.

In one embodiment, the system 100 includes devices that enable the user computing devices 102 to transmit and receive data to and from the user server 104. The devices may include one or more communication satellites 122, one or more cellular towers 124, and devices forming one or more wired or wireless networks 126. In one embodiment in which the user computing devices 102 are cellular phones, the user computing devices 102 may communicate with the user server 104 by transmitting signals to the cellular tower 124 which then transmits the signals to the communication satellite 122. The communication satellite 122 transmits the signals to the user server 104. In turn, the user server 104 may transmit signals to the user computing devices 102 in the reverse direction via the communication satellite 122 and the cellular tower 124. It should be appreciated that the user computing devices 102 may communicate with the user server 104 via one or more wired or wireless of the networks 126, such as the Internet.

In one embodiment, the signals transmitted between the user computing devices 102 and the user server 104 are encrypted using a suitable encryption algorithm. For example, the signals may be encrypted using a public key infrastructure (PKI) algorithm. In another embodiment, the signals may be encrypted using any suitable algorithm.

Figure 2:
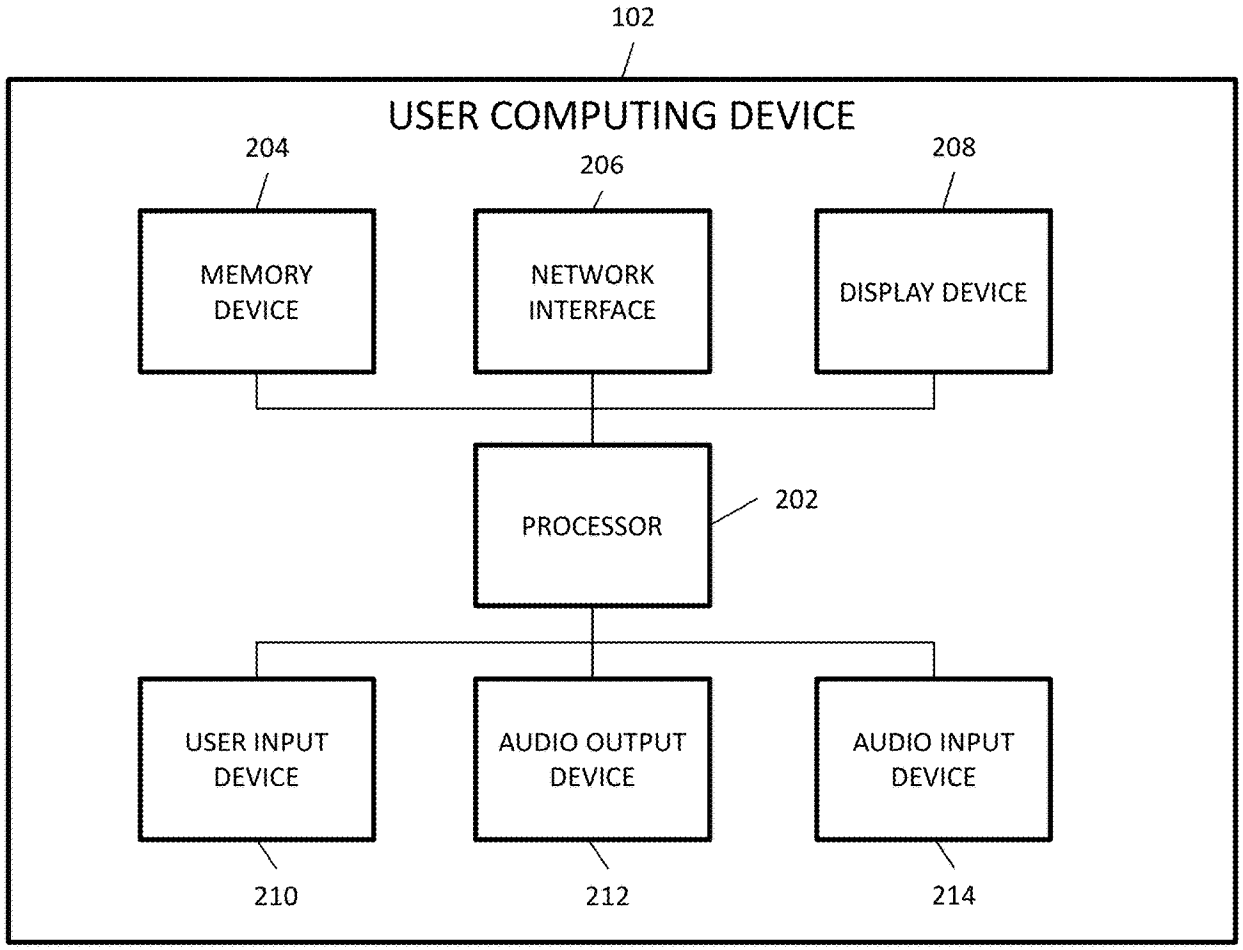
FIG. 2 is a block diagram of a user computing device that may be used with the system shown in FIG. 1.

FIG. 2 is a block diagram of one embodiment of the user computing device 102 that may be used with the system 100 (shown in FIG. 1). In one embodiment, the user computing device 102, user server 104, and/or bet server 106 described in the system 100 may be implemented as the user computing device 102. However, it should be recognized that one or more components of the system 100 may not be included in the user computing device 102 such as the user server 104, and/or bet server 106.

In one embodiment, the user computing device 102 includes a processor 202, a computer-readable memory device 204, and a network interface 206. In one embodiment, the user computing device 102 may also include a display device 208, a user input device 210, an audio output device 212, and/or an audio input device 214. It should be appreciated that the memory device 204, network interface 206, display device 208, and user input device 210 (if provided) may be connected to the processor 202 and/or to each other via any suitable bus or busses, interfaces, or other mechanisms.

The processor 202 includes any suitable programmable circuit including one or more microcontrollers, microprocessors, application specific integrated circuits (ASICs), systems on a chip (SoCs), programmable logic circuits (PLCs), field programmable gate arrays (FPGAs), and/or any other circuit capable of executing an algorithm with instructions for the steps or functions described herein. It should be appreciated that the above examples are exemplary only, and thus are not intended to limit in any way the definition and/or meaning of the term "processor."

The memory device 204 is an electronic storage device that includes one or more non-transitory computer readable medium, such as, without limitation, random access memory (RAM), flash memory, a hard disk drive, a solid state drive, a compact disc, a digital video disc, and/or any suitable memory. The memory device 204 may include data as well as an algorithm with instructions that is executable by the processor 202 to program the processor 202 to perform the steps or functions described herein. For example, the methods described herein may be performed by one or more processors 202 executing an algorithm with instructions stored within one or more of the memory devices 204.

The network interface 206 may include, without limitation, a network interface controller (NIC) or adapter, a radio frequency (RF) transceiver, a public switched telephone network (PSTN) interface controller, or any other communication device that enables the user computing device 102 to operate as described herein. In one embodiment, the network interface 206 may connect to the network interfaces 206 of the other user computing devices 102 of the system 100 through a network using any suitable wireless or wired communication protocol.

The display device 208 may include, without limitation, a liquid crystal display (LCD), a vacuum fluorescent display (VFD), a cathode ray tube (CRT), a plasma display, a light-emitting diode (LED) display, a projection display, a display integrated into a virtual reality or augmented reality device, and/or any suitable visual output device capable of displaying graphical data and text to a user. For example, the display device 208 may be used to display a graphical user interface 500 (to be described) associated with the application 108 to the user.

The user input device 210 may include, without limitation, a keyboard, a keypad, a touch screen, a mouse, a scroll wheel, a pointing device, a video input device that registers movement of a user (e.g., usable with an augmented reality input device or a virtual reality input device), and/or any other suitable device that enables the user to input data into the user computing device 102 and/or retrieve data from the user computing device 102.

The audio output device 212 may include, without limitation, one or more speakers or any other device that enables content to be audibly output from the computing device 200. For example, music or other audio content associated with one or more games may be audibly output from the audio output device 212.

The audio input device 214 may include a microphone or another suitable device that enables the user to input audio commands into the user computing device 102. The audio input device 214 may employ speech recognition software to convert spoken commands from the user into digital data for use in operating the user computing device 102.

While the foregoing components have been described as being included within the user computing device 102, it should be appreciated that at least some of the user computing devices 102 may not include each component. For example, a server may not include the audio output device 212, audio input device 214, user input device 210, and/or display device 208. In addition, the user computing device 102 may include any suitable number of each individual computing device component. For example, the user computing device 102 may include a plurality of the processors 202 or processor cores, a plurality of the memory devices 204 (of the same or different types, sizes, etc.), and/or a plurality of the display devices 208.

Figure 3:
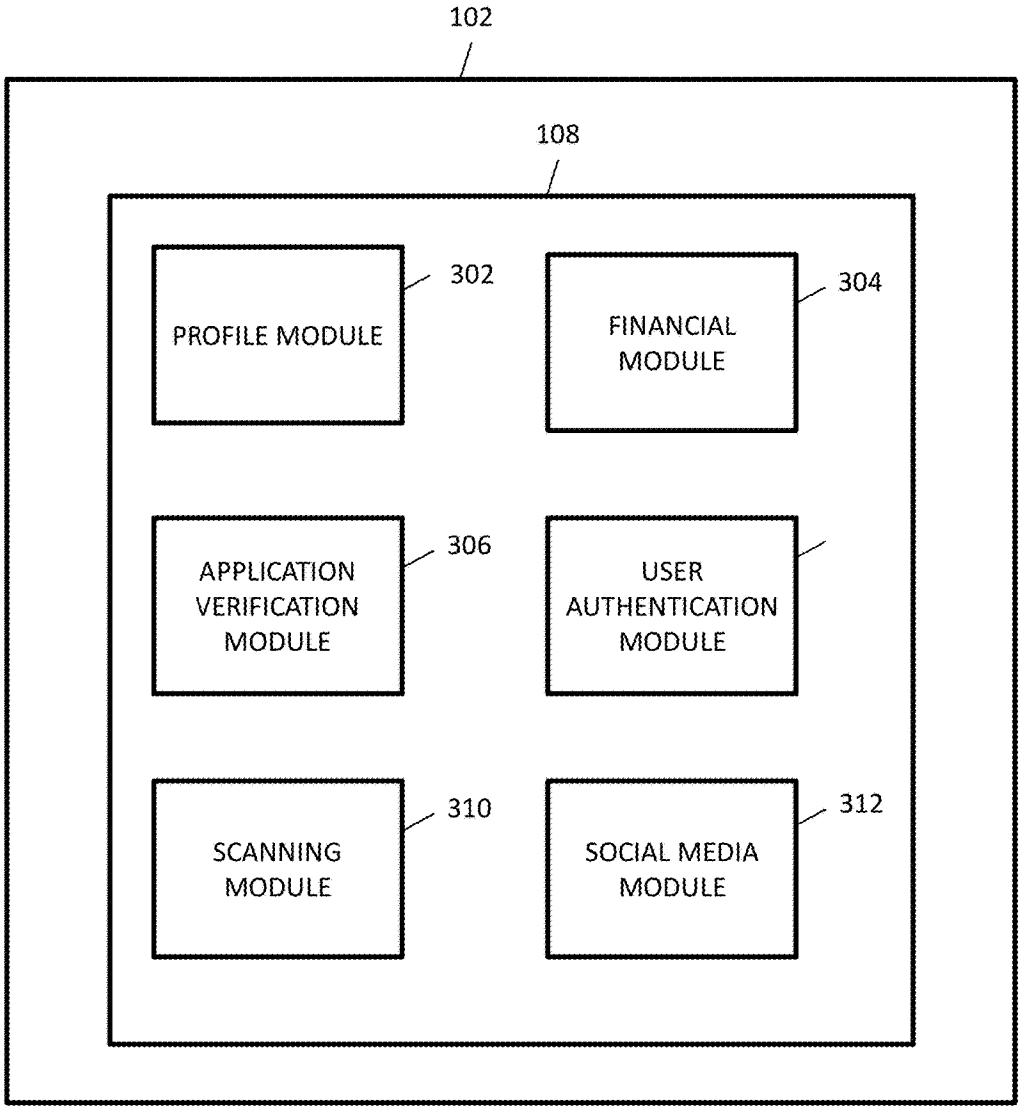
FIG. 3 is a block diagram of an exemplary application that may be used with the user computing device shown in FIG. 2.

FIG. 3 is a block diagram of an exemplary application 108 that is executable on the user computing device 102 (shown in FIG. 2) and that may be used with the system 100 (shown in FIG. 1). In one embodiment, the user computing device 102 may include a plurality of modules that may be embodied as one or more software modules within the application 108. In another embodiment, each module may include firmware and/or hardware components in addition to, or instead of, the software components within the application 108. The modules may include, for example, a profile module 302, a financial module 304, an application verification module 306, a user authentication module 308, a scanning module 310, and a social media module 312.

The profile module 302 is a module that stores user information such as username, full name, email address, password, and telephone number that is personal to the user. The profile module 302 may be used to display the profile of a user to another user.

The financial module 304 is a module that stores payment or account information. The information is securely stored in encrypted files within the financial module 304. The information may be unlocked or decrypted using, for example, a password, a pin number, a pattern entered into the user input device 210, a scan of the user's fingerprint, and/or any other suitable key. Additionally, the financial module 304 may be linked to a bank or other suitable account.

The application verification module 306 may be executed by the processor 202 to verify the integrity of the application 108 to the user server 104. For example, when the processor 202 uses the application 108 to initiate a connection with the user server 104, the user server 104 may request application integrity or verification information from the application verification module 306 to ensure that the application 108 has not been tampered with or otherwise altered in an unauthorized manner. Accordingly, the application verification module 306 may calculate and store a digital fingerprint of the application 108, such as by executing a hash algorithm on the files of the application 108. The resulting application fingerprint may be stored in the application verification module 306 (or another suitable portion of the memory device 204) and may be transmitted to the user server 104 in response to receiving an application verification or integrity request from the user server 104. The user server 104 may compare the application fingerprint to a reference fingerprint stored on the user server 104 to verify the application fingerprint (and thus the application 108). If the application fingerprint matches the reference fingerprint, the application 108 (and by extension, the user computing device 102) may be verified and may be allowed to access the user server 104 to place wagers, for example.

The user authentication module 308 may be executed by the processor 202 to authorize a user (also referred to as a player) to access the application 108 on the user computing device 102 and/or to access the user server 104 using the user computing device 102. For example, when a user opens or accesses the application 108 using the user computing device 102, the user authentication module 308 may prompt the user to enter a username and password, or another suitable access key such as a fingerprint or secure key fob, to access the application 108 and/or to log in to the user server 104. The user authentication module 308 may transmit a connection request to the user server 104 with the username and password (or other access key) entered by the user. The account server 104 may compare the username and password (or a fingerprint of either or both) to a stored record containing the correct username and password of the user. If the username and password are correct, the user server 104 may enable the application 108 (and the user computing device 102) to access the user's financial information on the user server 104 and to place wagers using the financial information, for example.

The scanning module 310 may be executed by the processor 202 to capture an image of a user identification document, such as a passport or driver's license. The image may be stored in the scanning module 310 (or another suitable portion of the memory device 204) and may be transmitted to the account server 104 to enable the user to sign up for an account. The scanning module 310 may also capture an image of the user's face for identification purposes, and/or may capture an image of a barcode or the like.

The social media module 312 may be executed by the processor 202 to display social media feeds or other content to the user. The social media feeds may be transmitted by the user server 104 or by another suitable server coupled to the user computing device 102. The social media module 312 may also be used to log the user into one or more social media accounts to enable the user to post content on the social media accounts and to access friend or contact lists, for example.

Figure 4:
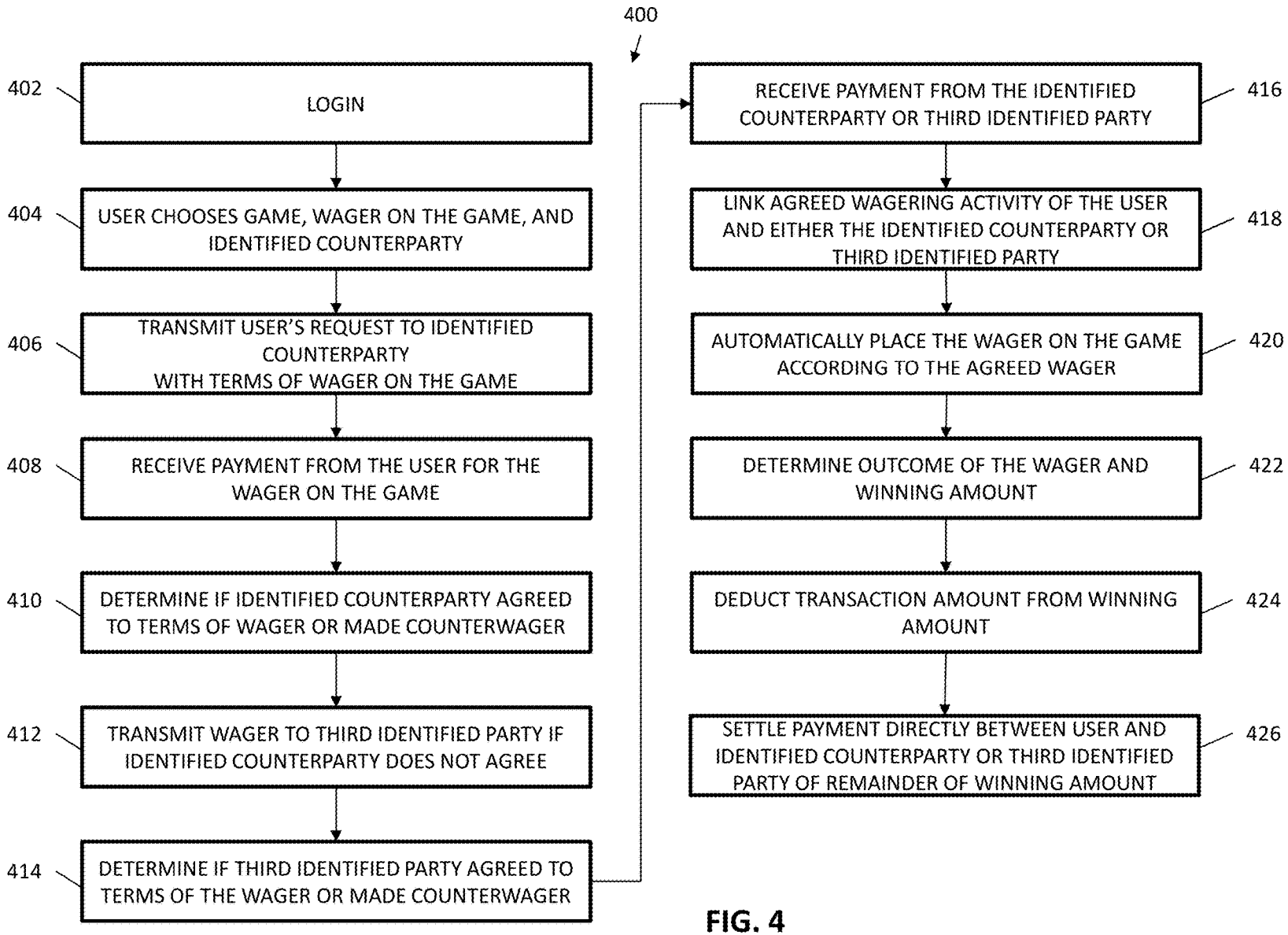
FIG. 4 is a flowchart of an exemplary method of peer-to-peer wagering that may be used with the system shown in FIG. 1.

FIG. 4 is a flow diagram of an exemplary method 400 of peer-to-peer wagering or betting on a game, such as a sports game, that may be used with the system 100 (shown in FIG. 1). While the method 400 is described with reference to a sports wagering game, it should be appreciated that the method 400 may be used with any suitable wagering game, such as poker, blackjack, horse racing, and the like. The method 400 may be implemented by the user computing device 102, user server 104, and/or bet server 106 (shown in FIG. 1), such as by the processor 202 of the user computing device 102, user server 104, and/or bet server 106 executing an algorithm with computer-readable instructions stored within the memory device 204 of the user computing device 102, user server 104, and/or bet server 106. In another embodiment, the method 400 may be implemented by any suitable device of the system 100.

In one embodiment, the method 400 includes the step 402 of logging in by a user of the user computing device 102 of a wagering application (or app), such as the application 108, to wager on one or more sports wagering games. For example, a user may use a cellular phone to access the application 108 to place one or more wagers on one or more wagering games. The method 400 includes the step 404 in which the user chooses or selects the wagering game, wager on the wagering game, and the counterparty. For example, the user may select a football game, twenty dollar wager on the game, and a coworker or friend. The method 400 includes the step 406 in which the user transmits the request to the counterparty. For example, the user or party transmits a request or Bet Invite (to be described) of the terms of the wager, for example the game and wager of the wagering game, to the user server 104 and a mobile notification to the counterparty altering them to the wager with the user computing device 102. Before the request is transmitted to the counterparty, the method 400 includes the step 408 of receiving payment from the user for the wager on the wagering game. For example, the user pays by entering his/her credit card information or uses financial information stored in the financial module 304. The method 400 includes the step 410 of determining if the counterparty agreed to the terms of the wager or made a counterwager. For example, the user receives a notification that the counterparty has accepted the wager or Bet Invite. The method 400 includes the step 412 of transmitting the wager to the user server 104 on behalf of the user if counterparty does not agree. For example, the application 108 transmits a notification to the user server 104 that the wager has not been accepted. The method 400 includes the step 414 of determining if a third party on the user server 104 agreed to terms of the wager or made a counterwager. For example, the user server 104 receives a notification that the third party has agreed to the wager. The method 400 includes the step of 416 of receiving payment from the counterparty or the third party. For example, the third party pays by entering his/her credit card information or uses financial information stored in the financial module 304. The method 400 includes the step 418 of linking the agreed wagering activity of the user and either the counterparty or the third party by the user server 104. For example, the user server 104 links the agreed wagering activity of the user and either the counterparty or the third party together and transmits the link to the bet server 106. The method 400 includes the step 420 of automatically placing the wager on the wagering game according to the agreed wagering activity. For example, the bet server 106 then places the wager for the user and automatically places the same wager on the same wagering game on behalf of the counterparty. The method 400 includes the step 422 of determining the outcome of the wager and winning amount. For example, the bet server 106 determines who won the wager and calculates the winning amount. The method 400 includes the step 424 of deducting a transaction amount from the winning amount. For example, the bet server 106 detects a predetermined amount or percentage from the winning amount. The method 400 includes the step 426 of distributing the remainder of the winning amount to the winner of the wager. For example, the bet server 106 distributes an associated winning amount to each user that won the wager.

In one embodiment, the method 400 may include fractional (aka partial) filling of bets. The method 400 allows for a partial filling of a public bet. The remaining amount of the bet that was unfilled would remain public. In one example, a first user makes a bet of $100 public and makes some notation that he/she is open to "fractional (or Partial) filling" of the bet. A second user wants to bet against the first user, but only has $60 in his/her account. Since the first user has noted that he/she is open to this bet being filled partially/fractionally (i.e. not fully), the second user can take the other side of the first user's bet for $60, leaving the first user with a still-unfulfilled bet of $40 with the same terms still available to a third party. It should be appreciated that the method 400 allows the user in-play and proposition betting as an option as well.

In another embodiment, the method 400 may include auto-match of identical public bets of opposite sides. Similar to the fractional filling of bets, the method 400 allows the user to affirm that the system 100 can automatically pair them against another user with the opposite side public bet that the original user or party may have missed in their search for a counterparty to bet. For example, a user submits a public bet for one team in a football wagering game for a wager of $100, another user already had a public bet for the opposing team on the same wagering game for a wager of $100, and the system 100 automatically pairs the user and the another user to bet against each other since the wager was matched perfectly.

In another embodiment, the method 400 may provide the users the option to approve fractional filling of auto-matched bets as well. In one embodiment, the user can select a button that allows a bet to be filled partially or fractionally as previously described. In one embodiment, the user can select a button that allows a bet to be auto-matched as previously described. In one embodiment, the user can select a button that allows their auto-matched bet to be filled fractionally. For example, if a first user has an outstanding (auto-match=OK) bet for $100 for two hours before the wagering game and a second user comes on and submits a $60 bet (auto-match=OK) on the same wagering game for the opposite side, those two bets would get filled with each other (leaving the first user with $40 remaining that never got filled) within a certain time frame prior to the wagering game. In one embodiment, the method 400 may include a predetermined time limit such as a fifteen (15) minute time limit, meaning that any opposite-side bets outstanding within fifteen (15) minutes of the wagering game starting are automatically matched with a counterpart, even if the bet values don't add up. It should be appreciated that the goal is not to have any outstanding bets at the start of any wagering game and to transact on as much volume/clearing/matching as possible.

In one embodiment, the wagering activities and results are tracked for each user who is using the system 100 to wager on one or more wagering games. For example, as each user places a wager on a wagering game, the wager details are tracked and stored by the user server 104 or bet server 106 in the statistics database 124. The results of each wager (e.g., whether the user won the wager), are also stored in the statistics database 124.

Leaders are then identified for each wagering game. For example, the ranking module 122 may query the statistics database 124 after each wagering game concludes to determine which users have the highest win percentage for the particular wagering game or game type and may select those users to be leaders. In one embodiment, the ranking module 122 may query the statistics database 124 periodically, such as every 5 minutes, every hour, every day, or at any other suitable frequency to determine which users have the highest win percentage. In one embodiment, the ranking module 122 selects a predetermined number of the users with the highest win percentage for a wagering game to be leaders of that wagering game. While the ranking module 122 is described herein as selecting the predetermined number of users with the highest win percentage, it should be appreciated that other criteria may be used to select the leaders in addition to, or instead of, the highest win percentage. For example, the ranking module 122 may select the users with the highest total number of wins for a wagering game to be leaders of the wagering game, and/or may select leaders using any other suitable criteria.

The selected leaders for each wagering game are then ranked according to one or more ranking criteria. For example, the ranking criteria may include the number of wagers won, the win percentage of the user, alphabetical ranking based on user name, geographical ranking based on proximity to the user or based on a location or jurisdiction of the user, any combination of the foregoing, and/or any other suitable ranking criteria. The ranked list of leaders for each wagering game may be transmitted to the user computing device 102 to be displayed on the display device 208.

Figure 5:
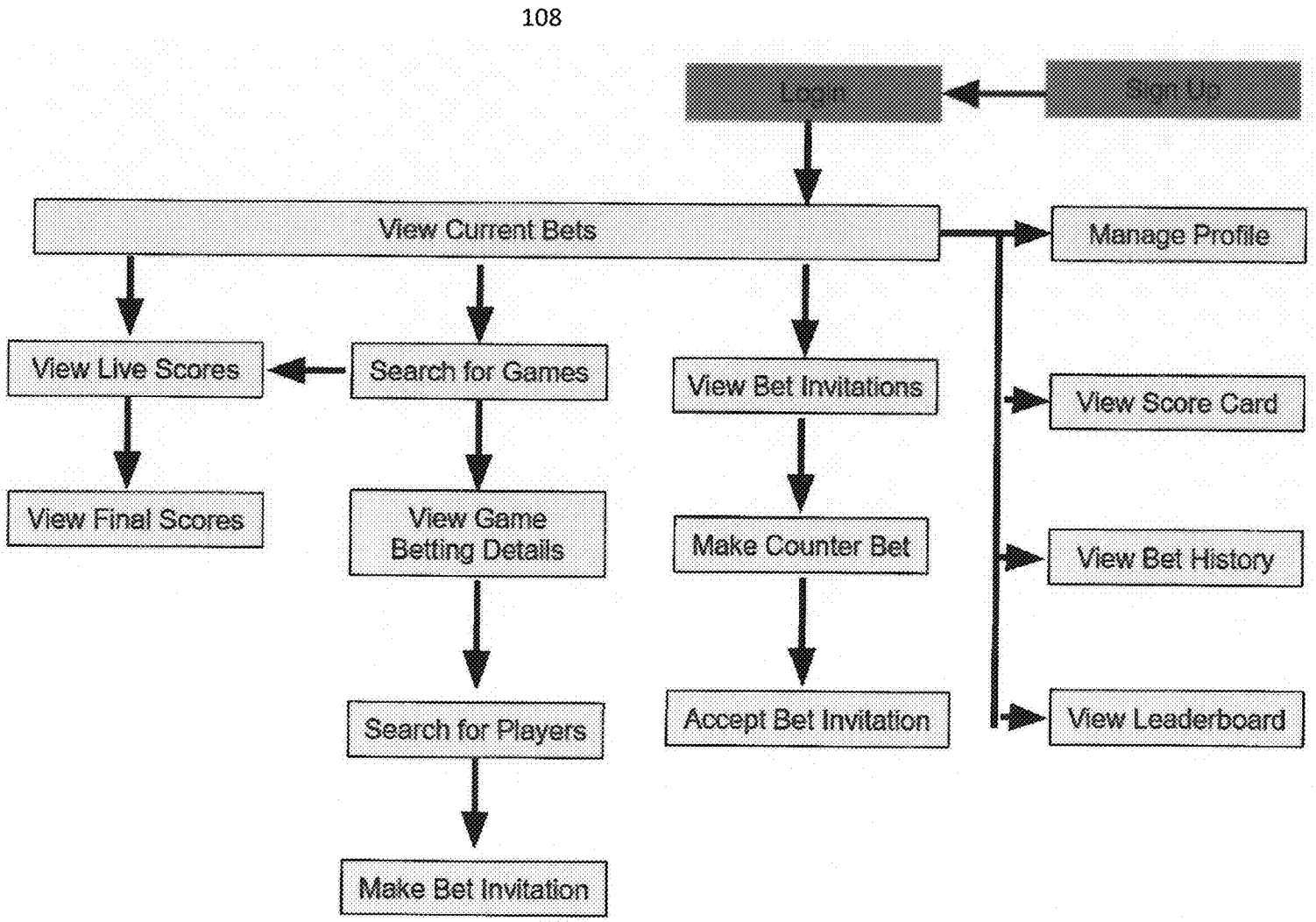
FIG. 5 is an overall flow diagram of an exemplary application for peer-to-peer wagering that may be used with the user computing device shown in FIG. 2.

Referring to FIG. 5, an overall flow diagram of the application 108 is shown. In one embodiment, the user signs up to use the application 108. Once the user has signed up to use the application, the user logs into the application 108. Once the user is logged in, the user has a Home page to view Current Bets or wagers. From the Current Bets, the user can manage their Profile, view their User Score Card, view their User Bet History, and/or view the Current Leaderboard as previously described. From the Current Bets, the user can view Bet Invitations, make Counter Bets, and accept Bet Invitations. The user can also search for wagering games, view game betting details, search for players, and make bet invitations. The user can further view live scores after searching for wagering games or viewing current bets. From live scores, the user can view final scores.

Figure 6:
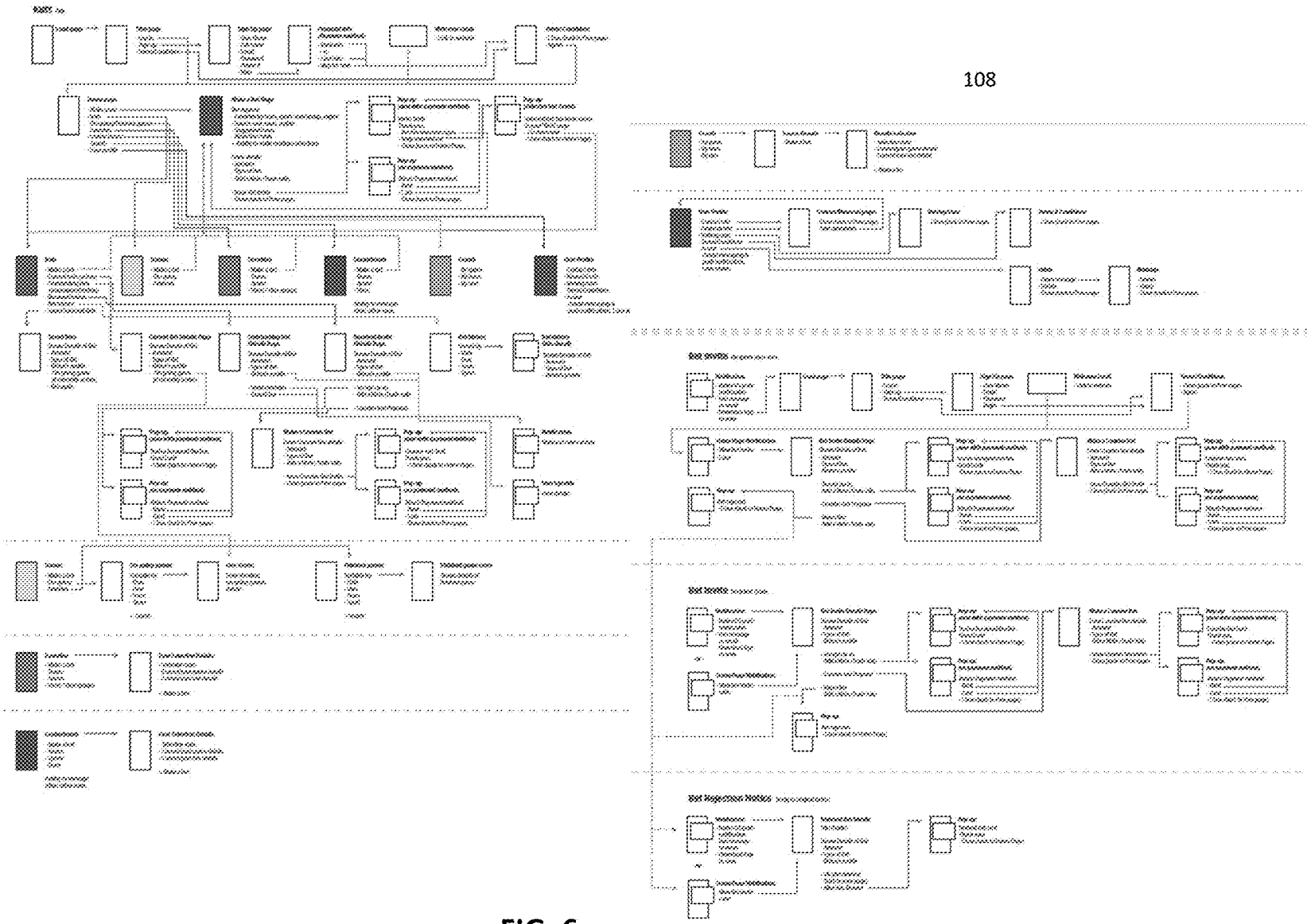
FIG. 6 is a detailed flow diagram of an exemplary application for peer-to-peer wagering that may be used with the user computing device shown in FIG. 2.

Referring to FIG. 6, a detailed flow diagram of the application 108 is shown. In this diagram, the application 108 loads the title page, which has a login, sign up, and terms and conditions (illustrated in FIG. 7A). To sign up, the application 108 presents a sign up page for the user to enter their user name, full name, email address, password, and telephone number, The application 108 presents a financial information page for the user to enter their financial information such as bank information or credit card information or the user may skip this page altogether. The application 108 sends a "welcome" email to the user at the user's email address with a link to a website. The application 108 presents a terms and conditions page to which the user has to click to agree and closes back to a Home page. From the Home page, the user can select make a bet, view bets, view on-going games, view favorites, view leaderboard, search, or view user profile as previously described.

Figure 7A:
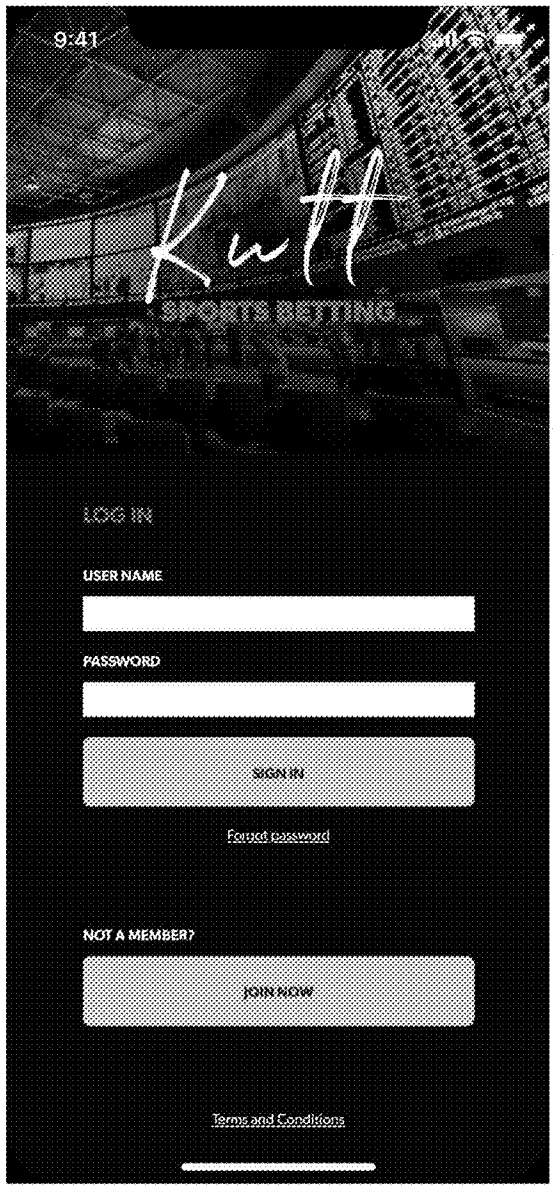
FIGS. 7A-7H are screen captures of an exemplary user interface that may be used with the application shown in FIGS. 5 and 6 and the user computing device shown in FIG. 2.
Figure 7B:
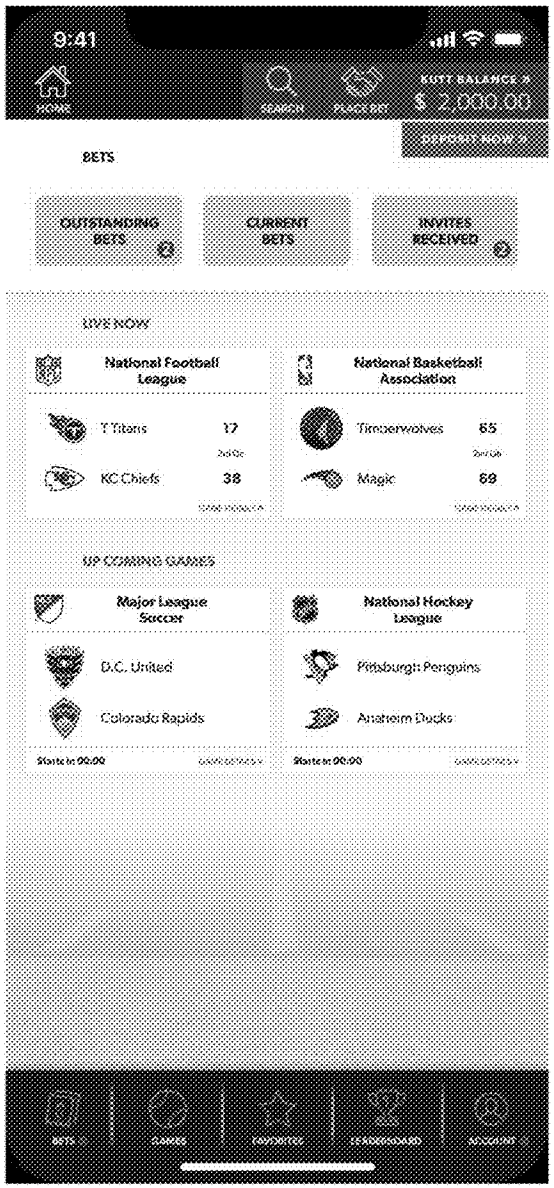

On the Home page, if the user selects to make a bet, the application 108 presents a Make a Bet page (illustrated in FIG. 7B). On the Make a Bet page, the user can bet against Favorites by team, sport, user/group, or region, search user, team, or region, suggested users, make a bet public, and/or ability to make multiple selections. The user enters details (illustrated in FIG. 7C) including amount and type of bet. The user can also add a note (e.g., Trash-talk). The application 108 issues a bet invite and closes back to the previous page. The application 108 then issues a Pop-up. For a Pop-up (user with payment method), the Pop-up includes Invite Sent!, Thank you., Bet this selection again, Keep selected bet, and Closes (back to Home Page). For a Pop-up (no user payment method), the Pop-up includes attach payment method, bank, card, and close (back to the previous page). There is also a Pop-up for selected bet saved. The Pop-up includes selected bet has been saved to your "Bets" page, Go there now, and close (back to Home page).

On the Home page, if the user selects "Bets", the application 108 presents a Bets page. On the Bets page, the user can make a bet, view current bets (active), view outstanding bets (unanswered invites), view received invites, view bet history, and view saved selected bets.

On the Bets page, if the user selects make a bet, the application 108 presents the Make a Bet page as previously described.

On the Bets page, if the user selects view current bets, the application 108 presents a Current Bets details page. The Current Bets details page shows or displays details of the bet including amount, type of bet, bettor's profile, and on-going wagering game (if currently active). It should be appreciated that, for the on-going wagering game, the application 108 presents a Live Scores feed showing on-going wagering game's details.

On the Bets page, if the user selects view outstanding bets, the application 108 presents an Outstanding Bets details page. The Outstanding Bets details page shows or displays details of the bet including amount, type of bet, bettor's profile, and user's profile, which includes user details. The Outstanding Bets details page allows a user to send a reminder or cancel the bet and the application 108 sends a notification, which is a notice of the user's action.

On the Bets page, if the user selects view received invites, the application 108 presents a Received Invites details page. The Received Invites details page shows or displays details of the bet including amount, type of bet, bettor's profile, and user's profile, which includes user details. The Received Invites details page allows the user to accept (as-is), add a note (e.g., Trash-talk), or counter-bet proposal.

On the Received Invites details page, if the user selects accept (as-is), the application 108 then issues a Pop-up. For a Pop-up (user with payment method), the Pop-up includes You've Accepted the Bet, Good Luck!, and closes (back to previous page). For a Pop-up (no user payment method), the Pop-up includes attach payment method, bank, card, and closes (back to the previous page).

On the Received Invites details page, if the user selects counter-bet proposal, the application 108 presents a Make a Counter Bet page. On the Make a Counter Bet page, the user enters counter bet details including amount, type of bet, and add a note (e.g., Trash-talk). The application 108 then issues a counter bet invite and closes back to the previous page. The application 108 then issues a Pop-up. For a Pop-up (user with payment method), the Pop-up includes Counter Bet Sent!, Thank you., and closes (back to previous page). For a Pop-up (no user payment method), the Pop-up includes attach payment method, bank, card, and closes (back to the previous page).

On the Bets page, if the user selects received invites, the application 108 presents the Received Invites page as previously described.

On the Bets page, if the user selects bet history, the application 108 presents a Bet History page. The Bet History page allows the user to sort by date, user, team, and sport. The Bet History page shows details of the bet including amount, type of bet, and bettor's profile.

On the Bets page, if the user selects saved bets, the application 108 presents a Saved Bets page. The Saved Bets page shows details of the bet including amount, type of bet, and bettor's profile, on-going wagering game (if currently active), and bet again.

On the Home page, if the user selects on-going/finished wagering games, the application 108 presents a Games page to allow the user to make a bet, view on-going wagering games, and view finished wagering games.

On the Games page, if the user selects make a bet, the application 108 presents the Make a Bet page as previously described.

On the Games page, if the user selects on-going wagering games, the application 108 presents an On-going Games page. The On-going Games page allows a user to sort by date, user, team, and sport. The On-going Games page also allows the user to search for on-going wagering games. It should be appreciated that, for the on-going wagering game, the application 108 presents a Live Scores feed showing on-going wagering game's details.

On the Games page, if the user selects finished wagering games, the application 108 presents a Finished Games page. The Finished Games page allows a user to sort by date, user, team, and sport. The Finished Games page also allows the user to search for finished wagering games. It should be appreciated that, for the finished wagering game, the application 108 presents a finished game score showing details of the finished wagering game.

On the Home page, if the user selects Favorites, the application 108 presents a Favorites page to allow the user to make a bet, view teams, view sports, and view user groups.

On the Favorites page, if the user selects make a bet, the application 108 presents the Make a Bet page as previously described.

On the Favorites page, if the user selects view teams, view sports, or view user groups, the application 108 allow the user to view selection stats or statistics including current/past game details and current/past bet details.

On the Home page, if the user selects Leaderboard, the application 108 presents a Leaderboard page to allow the user to make a bet, view teams, view sports, view user groups, and the ability to message other users. It should be appreciated that the user could also make a bet.

On the Leaderboard page, if the user selects make a bet, the application 108 presents the Make a Bet page as previously described.

On the Leaderboard page, if the user selects view teams, view sports, or view user groups, the application 108 presents a Favorite Selection details page that allows the user to view selection stats or statistics including current/past game details and current/past bet details. It should be appreciated that the Favorite Selection details page also allows a user to make a bet.

On the Home page, if the user selects Search, the application 108 presents a Search page to allow the user to search by wagering game, team, and user. The application 108 presents a Search Results page showing selection statistics, current/past game details, and current/past bet details. It should be appreciated that the Search Results page also allows a user to make a bet.

On the Home page, if the user selects User Profile, the application 108 presents a User Profile page to allow the user to view contact information, financial information, betting statistics, terms/conditions, in-box, social messaging, and push notifications of the user. On the User Profile page, if the user selects to view contact information or financial information, the application 108 presents Contact/Financial pages to allow the user to view and edit the information, save the edits, and closes to the previous page. On the User Profile page, if the user selects to view the betting statistics, the application 108 presents a Betting Statistics page to allow the user to view their betting statistics and closes to the previous page. On the User Profile page, if the user selects to view the terms and conditions, the application 108 presents a Terms and Conditions page to allow the user to view the terms and conditions of the application 108 and closes to the previous page. On the User Profile page, if the user selects to view the in-box, the application 108 presents an In-box page to allow the user to open and delete messages and closes to the previous page. On the User Profile page, if the user selects to view the message, the application 108 presents a Message page to allow the user to delete the message, reply to the message, and closes to the previous page.

In one embodiment, the application 108 produces a Bet Invite to a non-user of the application 108. The Bet Invite is a notification to a non-user in the form of a Native OS push notification, text message, or email to download the application 108. The application 108 then loads a Load page and a Title page and the non-user enters their information as previously described. After the non-user agrees to the terms and conditions of the application 108, the application 108 presents the Home page. At the Home page, the non-user can view the Bet Invite now or later. If the non-user views the Bet Invite, the application 108 presents the Bet Invite details page as previously described.

In one embodiment, the application 108 produces a Bet Invite to a current user of the application 108. The Bet Invite is a notification to a current user in the form of a Native OS push notification, text message, or email to download the application 108. The application 108 then presents the Bet Invite page as previously described or the Home page. At the Home page, the current user can view the Bet Invite now or later. If the current user views the Bet Invite, the application 108 presents the Bet Invite details page as previously described.

In one embodiment, the application 108 produces a Bet Rejection Notice to the originator of the bet. The Bet Rejection Notice is a notification to a current user in the form of a Native OS push notification, text message, or email to download the application 108. The application 108 then presents a Bet Rejection details page or the Home page previously described. At the Home page, the user can view the Bet Invite now or later. If the user views the Bet Invite, the application presents the Bet Rejection details page. At the Bet Rejection details page, the application 108 can send a "No Thanks" to the originator of the bet, shows details of the bet such as amount, type of bet, bettor's profile, reply OK (Bet deleted and back to previous page), or alter or change the bet and resend. After the user indicates the action on the Bet Rejection details page, the application 108 presents a Pop-up of Revised bet sent "Thank you!" and closes back to the Home page.

FIGS. 7A-7H are screen captures showing an exemplary user interface 500 of a sports wagering application, such as the application 108 (shown in FIG. 1). While the following user interface is illustrated in FIGS. 7A-7H as being presented on a mobile phone, it should be recognized that the user interface 500 may be presented on any suitable user computing device 102.

FIG. 7A is a screen capture showing the user interface 500 with a login page for a user using the application 108.

FIG. 7B is a screen capture showing the user interface 500 with a Bets page of a user using the application 108.

Figure 7C:
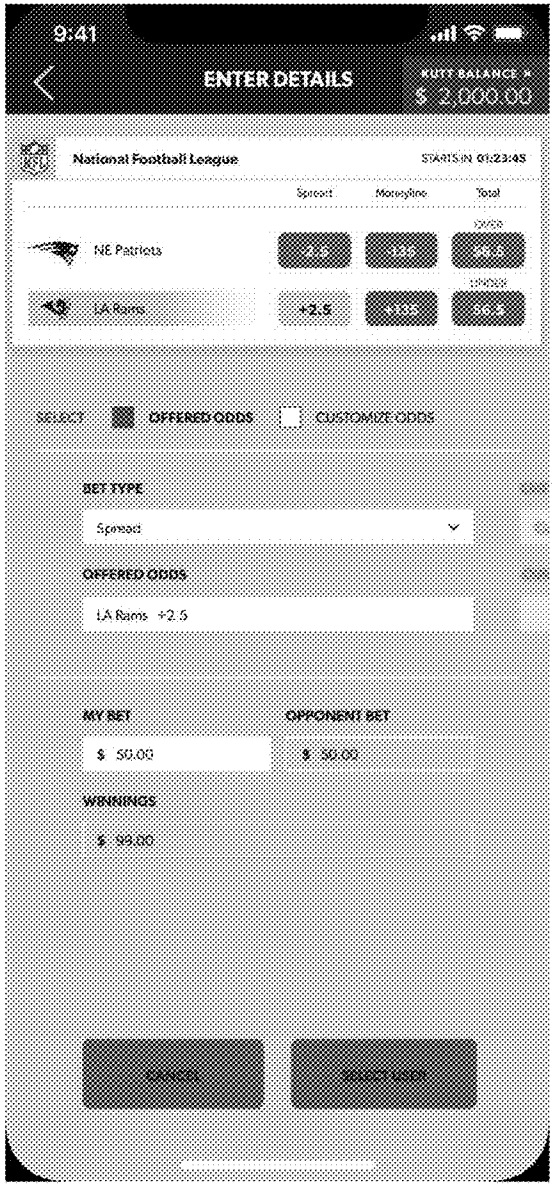

FIG. 7C is a screen capture showing the user interface 500 entering details of a bet from a user using the application 108.

Figure 7D:
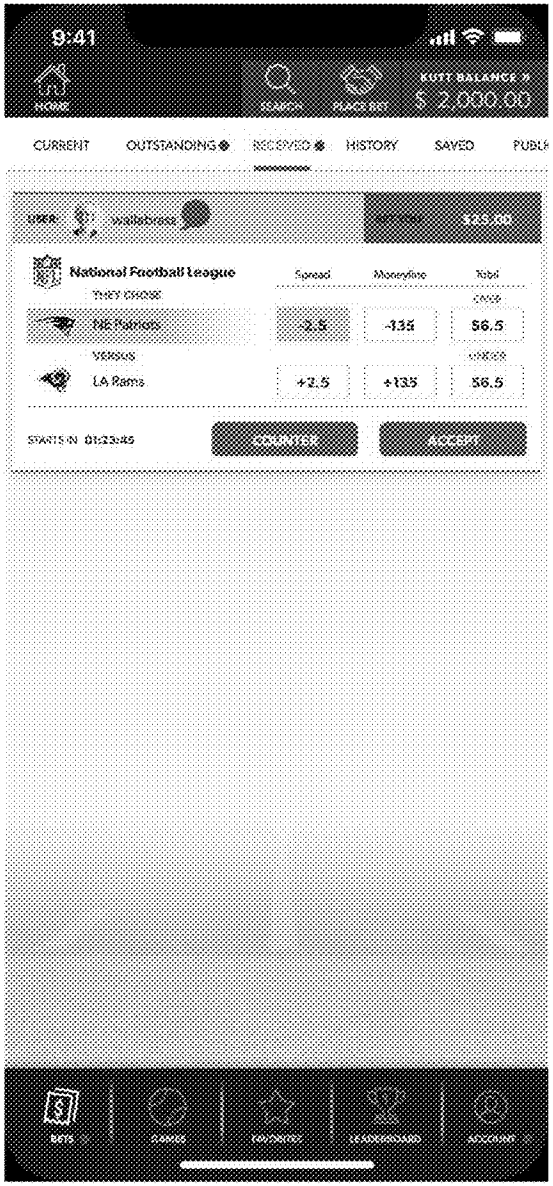

FIG. 7D is a screen capture showing the user interface 500 receiving a bet from another user using the application 108.

Figure 7E:
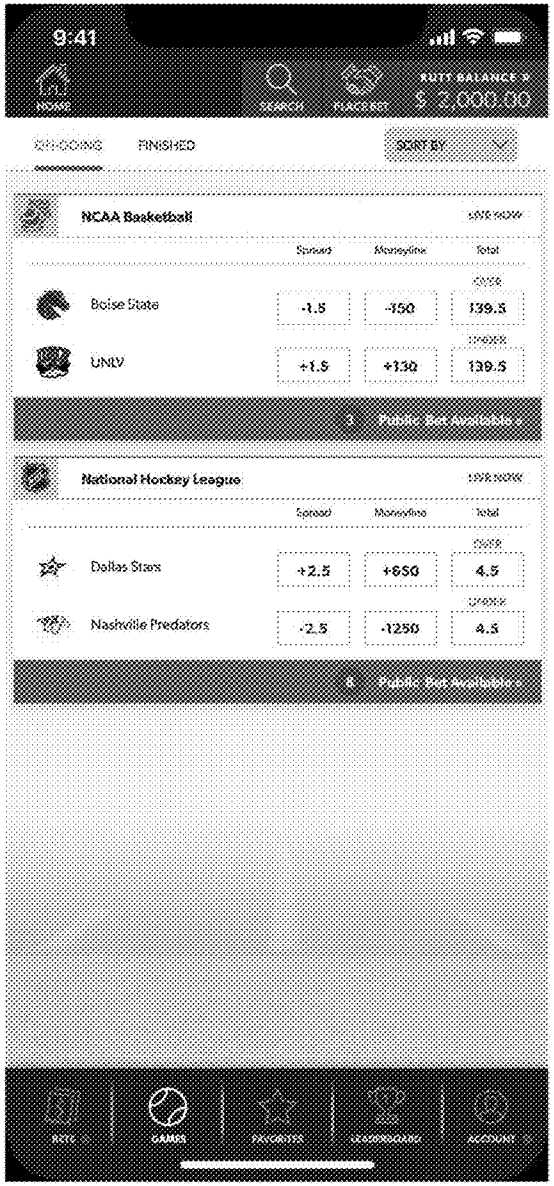

FIG. 7E is a screen capture showing the user interface 500 with an on-going wagering game sorted by wagering game.

Figure 7F:
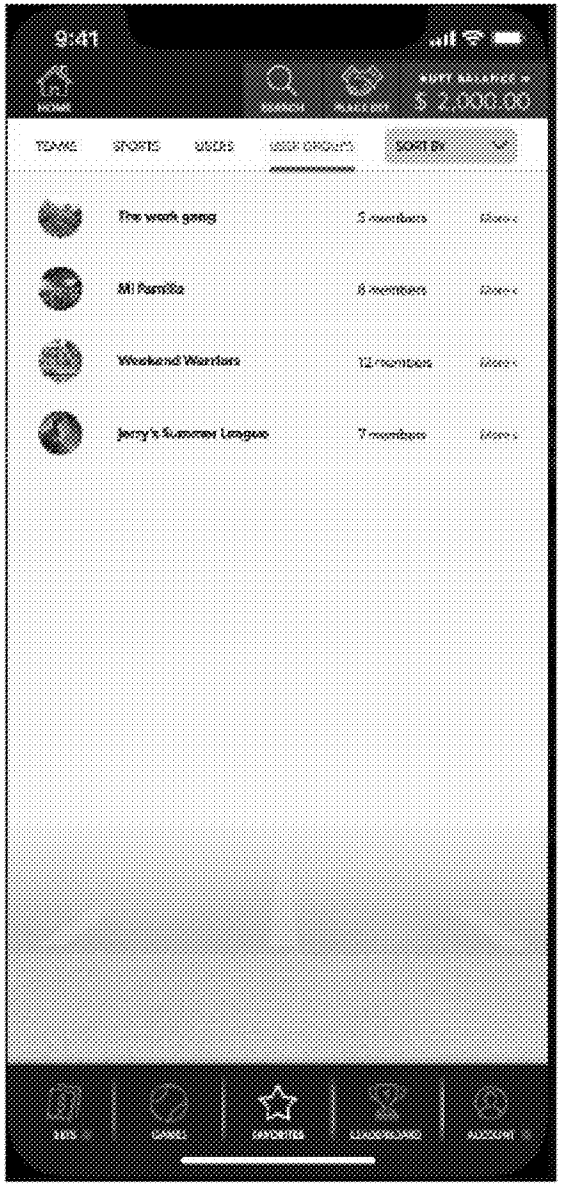

FIG. 7F is a screen capture showing the user interface 500 with users sorted by user groups.

Figure 7G:
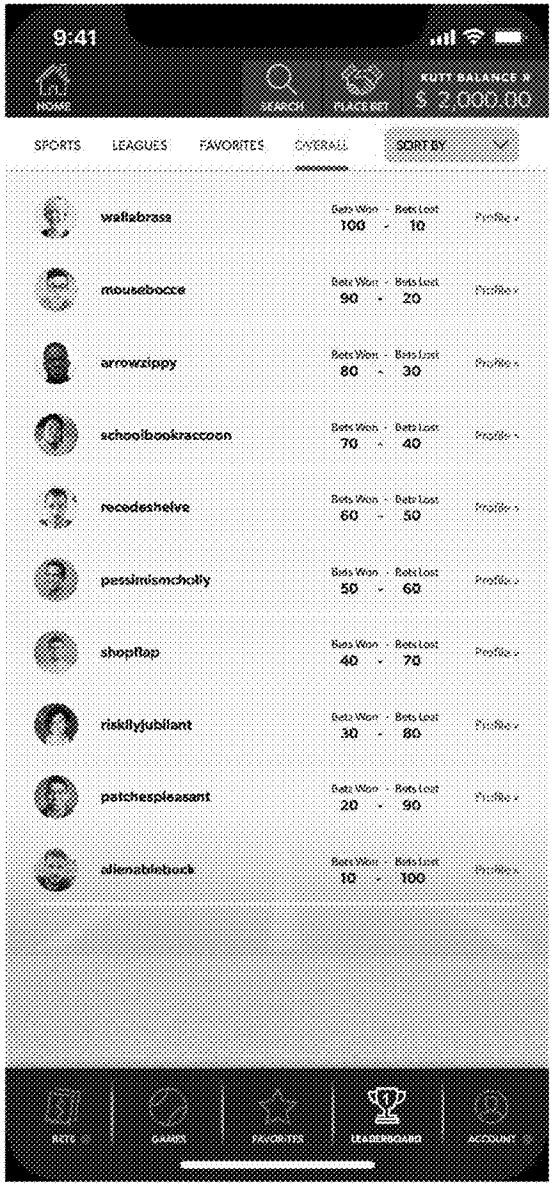

FIG. 7G is a screen capture showing the user interface 500 with users sorted by leaders.

Figure 7H:
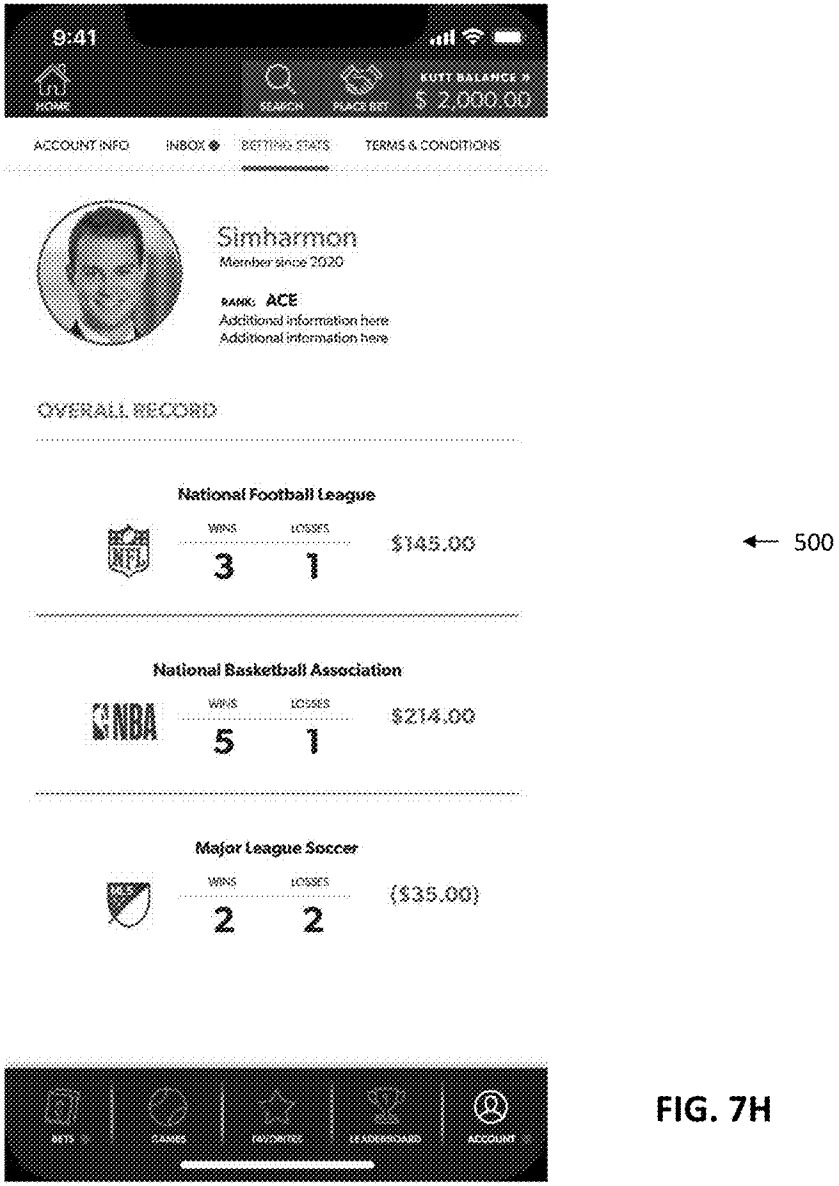

FIG. 7H is a screen capture showing the user interface 500 with betting statistic by a user.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for peer-to-peer wagering comprising:

a database configured to store data associated with a plurality of users, the associated data including statistics related to prior wagers made by each user;

a computing system configured to communicate with the database; and, an application executable by a processor of a user computing device and to communicate with the computing system, wherein the application is configured to have the processor execute an algorithm with instructions to:

enable the user to make a wager by selecting a wagering game and wager on the wagering game;

present a list of identified users to a user using the application on the user computing device;

enable the user to select one of the identified users from the list of identified users; and transmit terms of the wager to the selected identified user to the computing system;

wherein the computing system is configured to receive payment from the user for the wager on the wagering game;

determine if the identified selected user agreed to the terms of the wager or made a counterwager;

transmit the terms of the wager to the computing system for a third identified party of users if the selected identified user does not agree;

determine if the third identified party of the users agreed to the terms of the wager or made a counterwager;

receive payment from the selected identified user or the third identified party that has to be accepted before the wagering game occurs;

link an agreed wagering activity of the user and either the selected identified user or the third identified party to allow the agreed wager to be placed;

automatically place the wager on the wagering game according to the agreed wagering activity; and settle payment of the wager after the wagering game occurs directly between the user and the selected identified user or third identified party.

2. The system as set forth in claim 1, wherein the computing system is configured to transmit a Bet Invite to a device operated by the selected identified user in response to the user selecting the identified user.

3. The system as set forth in claim 1, wherein the computing system determines an outcome of the wager and winning amount.

4. The system as set forth in claim 3, wherein the computing system deducts a transaction amount from the winning amount.

5. The system as set forth in claim 4, wherein the computing system settles payment by distributing the remainder of the winning amount directly between the user and the identified selected user or third identified party.

6. The system as set forth in claim 1, wherein the list of users includes a ranked list of the users established as a function of the statistics stored in the database.

7. The system as set forth in claim 1, wherein the computing system publishes the wagering game within a peer-to-peer network forum.

8. A method for peer-to-peer wagering comprising the steps of:

storing, in a database, data associated with a plurality of users, the associated data including statistics related to prior wagers made by each user;

establishing, by a computing system, communication with the database;

executing an application by a processor of a user computing device to communicate with the computing system, wherein the application is configured to have the processor execute an algorithm with instructions:

enabling, by the application, the user to make a wager by selecting a wagering game and wager on the wagering game;

presenting, by the application, a list of identified users to a user;

enabling, by the application, the user to select one of the identified users from the list of identified users;

transmitting, by the application, terms of the wager to the selected identified user to the computing system;

receiving payment, by the computing system, from the user for the wager on the wagering game;

determining, by the computing system, if the selected identified user agreed to the terms of the wager or made a counterwager;

transmitting, by the application, the terms of the wager to the computing system for a third identified party of the users if selected identified user does not agree;

determining, by the application, if the third identified party of the users agreed to the terms of the wager or made a counterwager;

receiving, by the computing system, payment from the selected identified user or the third identified party that has to be accepted before the wagering game occurs;

linking, by the computing system, an agreed wagering activity of the user and either the selected identified user or the third identified party to allow the agreed wager to be placed;

automatically placing, by the computing system, the wager on the wagering game according to the agreed wagering activity; and settling payment of the wager, by the computing system, after the wagering game occurs directly between the user and the identified selected user or third identified party.

9. The method as set forth in claim 8, including the step of transmitting a Bet Invite to a device operated by the selected identified user in response to the user selecting the identified user.

10. The method as set forth in claim 8, including the step of determining an outcome of the wager and winning amount.

11. The method as set forth in claim 10, including the step of deducting a transaction amount from the winning amount.

12. The method as set forth in claim 11, wherein the step of settling payment comprises distributing, by the computing system, the remainder of the winning amount directly between the user and the identified selected user or the third identified party.

13. The method as set forth in claim 12, wherein the list of users includes a ranked list of the users established as a function of the statistics stored in the database.

14. The method as set forth in claim 13, including the step of publishing the wagering game within a peer-to-peer network forum.

15. A non-transitory computer readable medium having computer-executable instructions for execution by one or more computing devices for peer-to-peer wagering, the computer-executable instructions comprising the steps of:

enable the user to make a wager by selecting a wagering game and wager on the wagering game;

present a list of identified users to a user;

enable the user to select one of the identified users from the list of identified users;

transmit terms of the wager to the selected identified user;

receive payment from the user for the wager on the wagering game;

determine if the selected identified user agreed to terms of the wager or made a counterwager;

transmit the terms of the wager for a third identified party if selected identified user does not agree;

determine if the third identified party agreed to the terms of the wager or made a counterwager;

receive payment from the selected identified user or the third identified party that has to be accepted before the wagering game occurs;

link an agreed wagering activity of the user and either the selected identified user or the third identified party to allow the agreed wager to be placed;

automatically place the wager on the wagering game according to the agreed wagering activity; and settling payment of the wager after the wagering game occurs directly between the user and the selected identified user or third identified party.

16. The non-transitory computer readable medium of claim 15, wherein the computer-executable instructions comprise the step of transmitting a Bet Invite to a device operated by the selected user in response to the user selecting the user.

17. The non-transitory computer readable medium of claim 15, wherein the computer-executable instructions comprise the step of determining an outcome of the wager and winning amount.

18. The non-transitory computer readable medium of claim 17, wherein the computer-executable instructions comprise the step of deducting a transaction amount from the winning amount.

19. The non-transitory computer readable medium of claim 18, wherein the computer-executable instructions comprise the step of settling payment by distributing the remainder of the winning amount directly between the user and the identified selected user.

20. The non-transitory computer readable medium of claim 19, wherein the computer-executable instructions includes a ranked list of the users established as a function of the statistics stored in the database.

21. The non-transitory computer readable medium of claim 15, wherein the computer-executable instructions comprises the steps of publishing the wagering game within a peer-to-peer network forum.

* * * * *